United States Patent [19]

Minter

[11] Patent Number: 4,570,393

[45] Date of Patent: Feb. 18, 1986

[54] WEATHER SEAL FOR FRAME AND MOVABLE PANEL ASSEMBLY

[75] Inventor: Mearl Minter, Oshaloosa, Iowa

[73] Assignee: Rolscreen Company, Pella, Iowa

[21] Appl. No.: 456,256

[22] Filed: Jan. 6, 1983

[51] Int. Cl.[4] ..... E04F 19/00

[52] U.S. Cl. ..... 52/72; 52/200; 49/483; 49/484; 49/485

[58] Field of Search ..... 52/72, 200; 49/325, 49/483, 485, 495, 484

[56] References Cited

U.S. PATENT DOCUMENTS

| | | | |
|---|---|---|---|
| 1,811,718 | 6/1931 | Hofbauer | 49/484 |
| 2,892,220 | 6/1959 | Gillespie | 49/484 |
| 3,090,613 | 5/1963 | Bechtold | 52/72 |
| 3,665,661 | 5/1972 | Beckerer | 52/200 X |
| 3,815,299 | 6/1974 | Sorensen et al. | 52/72 |
| 4,449,340 | 5/1984 | Jentoft et al. | 52/200 |

FOREIGN PATENT DOCUMENTS

| | | | |
|---|---|---|---|
| 1904221 | 8/1970 | Fed. Rep. of Germany | 49/484 |
| 1099110 | 8/1955 | France | 49/484 |

*Primary Examiner*—Donald G. Kelly
*Assistant Examiner*—Creighton H. Smith
*Attorney, Agent, or Firm*—Zarley, McKee, Thomte, Voorhees & Sease

[57] ABSTRACT

In a frame and movable panel assembly, such as a ventilating skylight, a weather seal comprises a panel cap on the panel, a projection on the frame and a water dam on the projection. The cap defines a covered recess into which the projection enters upon closure of the panel on the frame, to provide a primary air tight seal. The dam simultaneously contacts the cap to provide a secondary water tight seal which protects the primary seal.

11 Claims, 4 Drawing Figures

38
60
68
71
70
66
90
82
72
18
16
46
52
54
50
58
62
64
94
95
96
28
44
40
24
42

38
60
68
71
70
66
88
90
84
82
92
74
80
78
72
18
16
46
52
54
50
56
48
62
64
94
95
96
28
58
44
40
24
42

WEATHER SEAL FOR FRAME AND MOVABLE PANEL ASSEMBLY

BACKGROUND OF THE INVENTION

This invention relates to weather seals, and more particularly, to a weather seal improvement in an assembly of a frame and movable panel, such as a ventilating skylight assembly.

Existing ventilating skylights suffer from a combination of ills. They sometimes leak during rain. They may jam and fail to close or open from frost build-up. When new, they may be difficult to open due to seal-created vacuums. They may deteriorate rapidly due to weather exposure. They may be difficult to install, inaccessible, and even when closed, may allow valuable heat to be lost to the outdoors. Nevertheless, ventilating skylights are desired for improved lighting, ventilation, and aesthetics.

SUMMARY OF THE INVENTION

An object of this invention is to provide an improved ventilating skylight.

Another object is to provide a ventilating skylight which overcomes deficiences of existing skylights in leakage, jamming, deterioration, installation and insulation.

Still another object is to provide a weather seal improvement for an assembly having a frame and movable panel, where the assembly may be a ventilation skylight assembly and the improvement may include primary, secondary and tertiary weather seals for the skylight.

In a principal aspect, the invention is the improvement of a weather seal in an assembly having a frame member and panel movable to and from the frame member. The seal comprises a panel cap, a projection and a water dam. The cap is on the panel and provides a covered recess. The projection is on the frame member and adapted to enter the recess when the panel is moved to the frame member. The projection provides a substantially air tight seal between the panel and frame member in the recess. The dam is on the projection, extending toward the position occupied by the cap when the panel is moved to the frame member. The dam provides a substantially water tight, but not air tight, seal against the cap. Thus, in a principal aspect, the invention provides an air tight primary weather seal and a water tight secondary seal. The primary seal is protected from the elements by the cap and secondary seal. Leakage of heat and rain is substantially prevented, opening occurs with ease, and deterioration is forestalled.

In other principal aspects, the invention further comprises a skylight with a clad exterior, solid wood frame, double insulating glass, attached mounting flange, interior screen, and tertiary seal directly against the glass. These and other aspects, objects, advantages and features of the invention will be explained in detail, in the Detailed Description which follows.

BRIEF DESCRIPTION OF THE DRAWING

A drawing accompanies this specification, and includes four figures, or FIGS., as follows.

Figure 1:
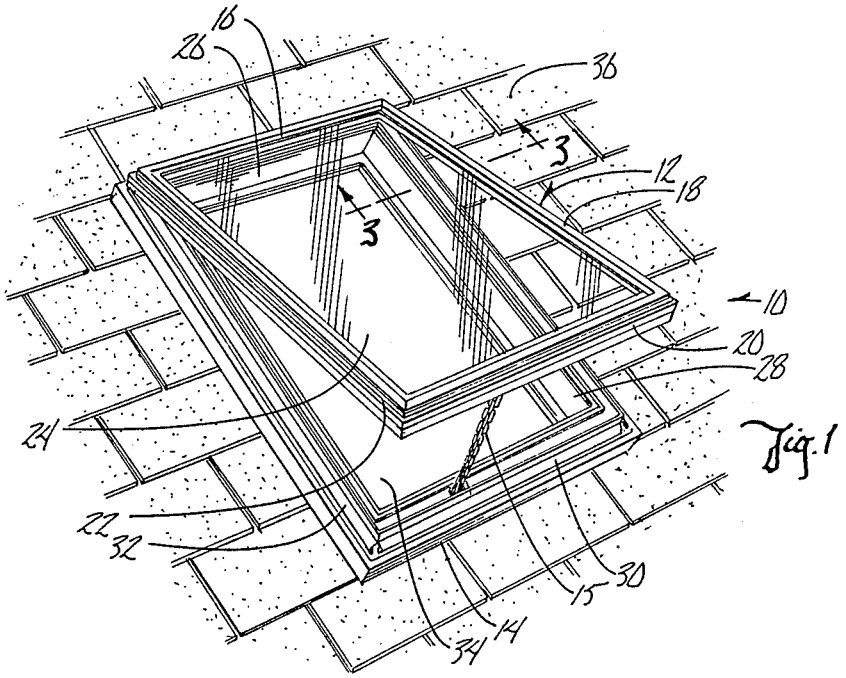
FIG. 1 is a perspective view of a preferred ventilating skylight of the invention, as installed and while open.

The preferred embodiment will now be described with reference to the drawing.

DETAILED DESCRIPTION OF THE PREFERRED EMBODIMENT

Referring to FIG. 1, the preferred ventilating skylight assembly 10 of the invention includes a sash 12 and a frame 14. Four sash panel member 16, 18, 20, 22 surround and hold a rectangular sash glazing panel 24. Four frame members 26, 28, 30, 32 define a rectangular opening 34 for the sash 12. The top sash member 16, or sash head, is hinged to the top frame member 26, or frame head, so that the sash 12 may be pivoted toward and away from the frame 14 by a crank mechanism 15. When the sash 12 is closed against the frame 14, each sash member 16, 18, 20, 22 contacts and rests upon its corresponding frame member 26, 28, 30, 32 to close the opening 34.

Figure 2:
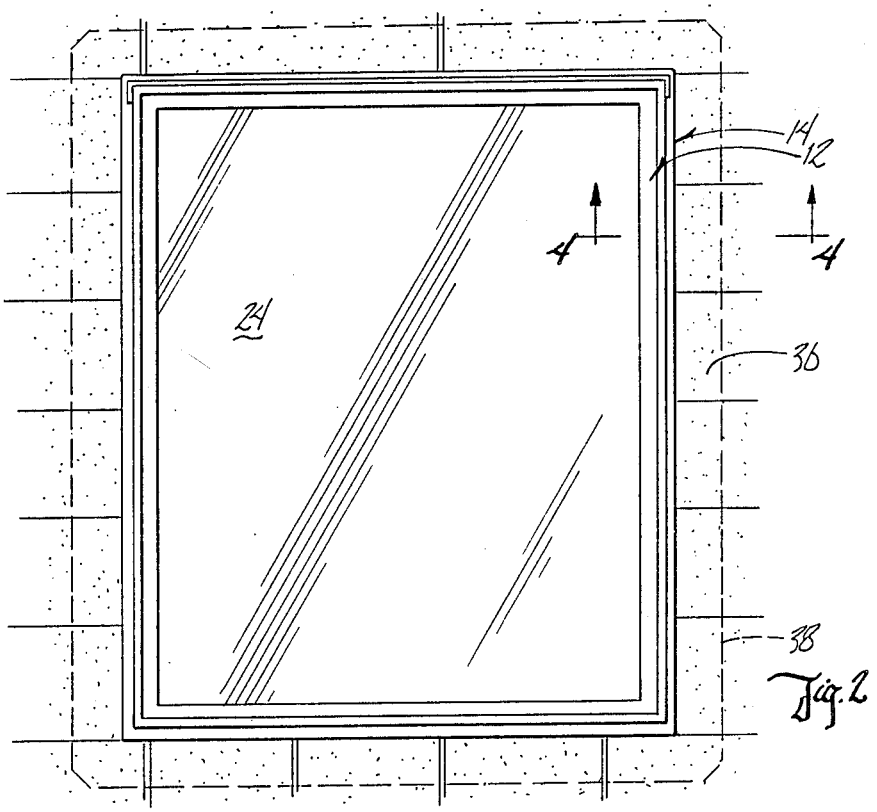
FIG. 2 is a plan view of the skylight of FIG. 1, while closed.

As shown, the skylight 10 may be mounted in a roof structure 36. A surrounding flange 38, shown in phantom in FIG. 2, extends from the frame members 26, 28, 30, 32 to provide to surface for roof fasteners such as roofing nails. In an existing roof, shingles are removed, an opening cut, a rough frame constructed, and the skylight fitted into place. The flange 38 is fastened and covered, shingles replaced, and a light shaft constructed.

Figure 4:
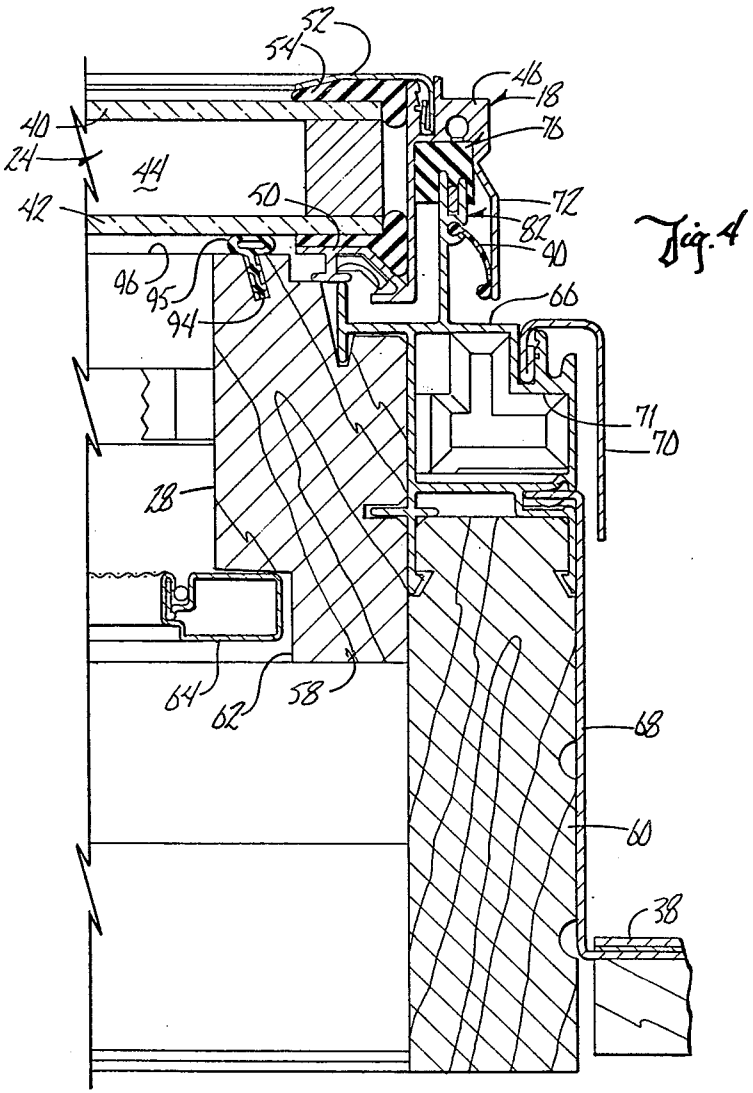
FIG. 4 is a cross-section view similar to FIG. 3, taken along line 4—4 in FIG. 2.
Figure 3:
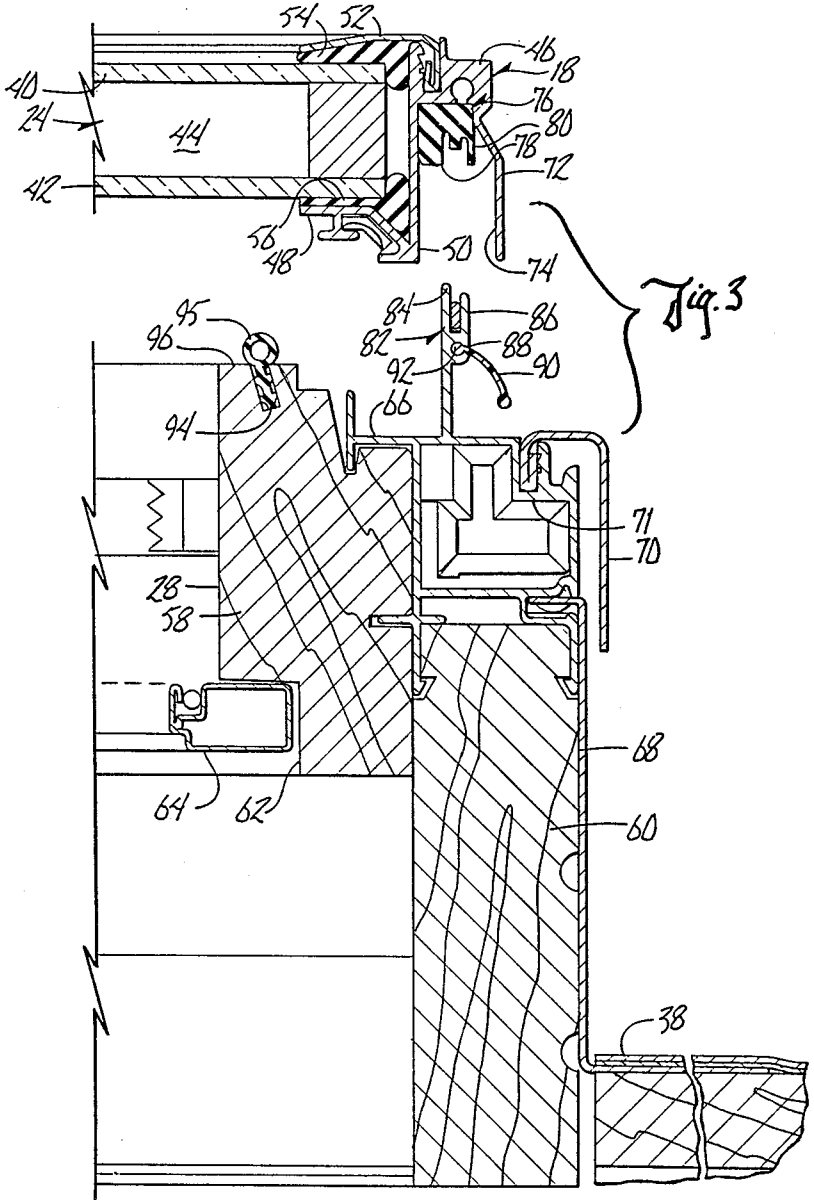
FIG. 3 is a cross-section view of the skylight, which reveals the preferred weather seal of the invention, the section having been taken along line 3—3 in FIG. 1.

Turning to FIGS. 3 and 4, the glazing panel 24 has two panes 40, 42 separated by a sealed, insulating air space 44. An aluminum sash rail 46 of the sash member 18 forms an underlying ledge 48 and outer side 50 for the glazing panel 24. An aluminum sash cover 52 fits and rail 46, to cover the glazing panel 24 and complete the sash member 18. An insulating, flexible filler in two beads 54, 56 joins the glazing panel 24 to the rail 46 and cover 52.

The frame member 28 includes a solid wood jamb stop 58 joined to a solid wood frame rail 60. A ledge 62 of the jamb stop 58 locates an interior screen 64. The interior faces of the jamb stop 58 and frame rail 60 are exposed wood, while the exteriors are clad by jamb cladding members 66, 68, 70. The jamb cladding member 66 forms a box 71 along the jamb stop 58 above the frame rail 60. The claddings members 68, 70 fit the member 66. The flange 38 is integral to the member 68.

The sash rail 46 extends outward of its outer side 50, to form a sash cap 72. A covered recess 74 is defined between the side 50 and cap 72, and a flexible weather strip 76 is fitted in the top of the recess 74, under the cap 72. The strip 76 is generally rectangular, with two upwardly extending grooves 78, 80 in its lower surface.

A jamb cladding frame projection 82 projects upward from, and is a part of, the jamb cladding member 66. The projection 82 is forked with tines 84, 86 at the upper end, to enter the grooves 78, 80 of the strip 76. When the sash 12 is closed against the frame 14, the projection 82 mates with the weather strip 76, to provide an air tight primary seal between the sash member 18 and frame member 28.

Below the outer tine 86, the projection 82 forms an outwardly open channel 88. A flexible, downwardly arched dam leaf 90 has an end 92 retained in the channel 88. The leaf 90 is cantilevered outward from the end 92.

When the sash 12 is closed on the frame 14, the leaf 90 brushes or wipes the inside of the sash cap 72, providing a substantially water tight but not air tight seal against the cap 72. Wind-blown water and the like are prevented from entering the recess 74 above the leaf 90. At the same time, air pressure remains equal across the leaf 90. The primary weather seal of the tines 84, 86 and strip 76 is protected, by the secondary seal of the leaf 90 and cap 72. No significant vacuum is created to resist opening of the sash 12.

A weather strip gasket 94 with a bulb 95 lies along the top surface 96 of the jamb stop 58. Interior to the gasket 92, the frame member 28 has no cladding. The gasket 94 is compressed against the lower glazing pane 42 when the sash 12 is lowered on the frame 14. The gasket 94 provides an air tight, tertiary seal to the skylight 10, separating moist interior air from the cladding of the sash 12 and frame 14. Thus, condensation and frost on the closed skylight 10 are substantially eliminated.

As should be apparent, FIGS. 3 and 4 are representative cross-sections, and all members shown are elongated and generally uniform throughout. Further, the sash member 18 and frame member 28 are representative of the other sash members 16, 20, 22 and frame members 26, 30, 32. The frame members 26, 28, 30, 32 are mitered and joined at the corners, as are the sash members 16, 18, 20, 22.

The skylight assembly 10 has many advantages. Because of the triple weather seal, rain leakage is substantially eliminated. Especially because of the tertiary seal, frost generally does not build up. The primary seal is protected from weather-caused deterioration by the leaf 90 and cap 72. Installation is facilitated by the flange 38. Heat loss is minimized by the double glazing and air space of panel 24, wood core of the frame 14 and the triple weather seals. Exterior deterioration is prevented by the exterior aluminum cladding. The importance of accessability is reduced because of the absence of necessary maintenance. Desired ventilation and light are amply provided.

While the preferred embodiment of the invention is described in relation to a ventilating skylight of specific structural details, the invention could be provided elsewhere. Therefore, to particularly point out and distinctly claim the subject matter regarded as invention, the following claims conclude this specification.

What is claimed is:

1. An improved weatherstripping assembly for use with a perimeter frame and a panel pivotally mounted to said frame and adapted to open from and close against said frame, said panel having a perimeter edge, said assembly comprising: a first flange extending upwardly from said frame; a second flange extending downwardly from said panel and being spaced apart from the perimeter edge of said panel to define a recessed area adjacent said edge of said panel; a first weatherstripping member operatively associated with said recessed area and said first flange; said first flange being adapted to enter said recessed area with said first weatherstripping member providing substantially air-tight sealing engagement between said panel and said frame upon closure of said panel against said frame; a second weatherstripping member operatively associated with said first flange and said second flange, said second weatherstripping member providing upon closure of said panel against said frame a non-air-tight substantially watertight seal between said panel and said frame; said second weatherstripping being spaced outwardly on said frame with respect to said first weatherstripping member so as to define an air space between said first and second weatherstripping member and being constructed of such flexible material so as to permit the air pressure to equalize on both sides of said second weatherstripping member when said panel is closed against said frame and whereby said second weatherstripping member functions as a water screen to protect said first weatherstripping member from moisture.

2. The assembly of claim 1 further comprising a third weatherstripping member mounted on said frame inwardly with respect to said first weatherstripping member for substantially air-tight sealing engagement with said panel upon closure of said panel against said frame thereby preventing condensation and frost from forming on said panel.

3. The assembly of claim 1 wherein said first weatherstripping member includes a panel cap secured to said panel to provide a covered recess adjacent the edge of said panel, and said frame includes an upwardly extending projection adapted to enter said recess and matingly engage said first weatherstripping member upon closure of said panel against said frame.

4. The assembly of claim 2 wherein said first weatherstripping member includes resilient element is secured within said covered recess for substantially air-tight engagement with said projection of said frame.

5. The assembly of claim 2 wherein said second weatherstripping member includes a flexible leaf cantilevered from said projection of said frame for non-air-tight frictional engagement with said panel cap upon closure of said panel against said frame.

6. The assembly of claim 2 wherein said third weatherstripping member includes a compressible water resistant bulbous body for air-tight compressive sealing engagement with said panel upon closure of said panel against said frame.

7. The assembly of claim 2 wherein said frame and said panel have exterior cladding and said third weatherstripping member prevents moist interior air from contacting said cladding of said frame and panel thereby preventing condensation and frost from forming on said panel.

8. The assembly of claim 2 wherein said third weatherstripping member extends substantially around the perimeter of said frame.

9. The assembly of claim 1 wherein said first and second weatherstripping members extend substantially around the perimeter of said panel and said frame, respectively.

10. The assembly of claim 1 wherein said frame and said panel are a ventilating skylight device.

11. An improved weatherstripping assembly for use with a perimeter frame and a panel pivotally mounted to said frame and adapted to open from and close against said frame, said panel having a perimeter edge, said assembly comprising:

a first flange extending upwardly from said frame;

a second flange extending downwardly from said panel and being spaced apart from the perimeter edge of said panel to define a recessed area adjacent said edge of said panel;

a first weatherstripping member mounted within said recessed area;

said first flange being adapted to enter said recessed area and matingly engage said first weatherstripping member so as to provide substantially air-tight sealing engagement between said panel and said frame upon closure of said panel against said frame;

a second weatherstripping member mounted on said first flange and extending downwardly and outwardly therefrom;

said second flange brushing downwardly across said second weatherstripping member into engagement therewith upon closure of said panel against said frame so as to provide non-air-tight substantially water-tight sealing engagement between said panel and said frame upon closure of said panel against said frame;

said second weatherstripping being spaced outwardly on said frame with respect to said first weatherstripping member so as to define an air space between said first and second weatherstripping member and being constructed of such flexible material so as to permit the air pressure to equalize on both sides of said second weatherstripping member when said panel is closed against said frame and whereby said second weatherstripping member functions as a water screen to protect said first weatherstripping member from moisture.

* * * * *